US005322357A

United States Patent [19]

Mazer

[11] Patent Number: 5,322,357

[45] Date of Patent: Jun. 21, 1994

[54] APPARATUS FOR BLENDING A POWDER WITH A LIQUID

[75] Inventor: Terrence B. Mazer, Reynoldsburg, Ohio

[73] Assignee: Abbott Laboratories, Abbott Park, Ill.

[21] Appl. No.: 77,158

[22] Filed: Jun. 14, 1993

Related U.S. Application Data

[63] Continuation of Ser. No. 705,989, May 28, 1991, abandoned.

[51] Int. Cl.[5] ..... B01F 7/04

[52] U.S. Cl. ..... 366/150; 366/263; 366/264; 366/290

[58] Field of Search ..... 366/263, 264, 290, 293, 366/150, 176, 279

[56] References Cited

U.S. PATENT DOCUMENTS

| | | | |
|---|---|---|---|
| 2,147,053 | 2/1939 | Owsley | 366/10 |
| 2,875,897 | 3/1959 | Booth | 209/69 |
| 3,256,181 | 6/1966 | Zingg et al. | 252/8.551 |
| 3,316,843 | 5/1967 | Vaughan | 417/430 |
| 3,423,075 | 1/1969 | Knudsen et al. | 366/181 |
| 3,503,846 | 3/1970 | Nardi | 162/236 |
| 3,606,270 | 9/1971 | Zimmerly | 366/263 |
| 4,208,134 | 6/1980 | Whittle | 366/147 |
| 4,778,280 | 10/1988 | Brazelton | 366/263 |
| 4,792,663 | 3/1988 | Karg | 366/165 |
| 4,850,704 | 7/1989 | Zimmerly et al. | 366/263 |
| 4,989,987 | 2/1991 | Berryman et al. | 366/263 |

*Primary Examiner*—Philip R. Coe
*Assistant Examiner*—Patrick F. Brinson
*Attorney, Agent, or Firm*—Lonnie R. Drayer; Donald O. Nickey

[57] ABSTRACT

An apparatus has the capacity to satisfactorily blend a liquid with a powder and pump the resultant viscous slurry in a single stage operation. The apparatus has a vertically oriented drive shaft with a bladed impeller attached to the drive shaft. A housing surrounds a mixing chamber in which the impeller is located. The lower end of a powder inlet tube is disposed in very close proximity to the highest vertical extent of the impeller blades. A liquid enters the mixing chamber exterior of the powder inlet tube. The resultant slurry leaves the mixing chamber via a slurry discharge port.

8 Claims, 4 Drawing Sheets

APPARATUS FOR BLENDING A POWDER WITH A LIQUID

This is a continuation of Ser. No. 07/705,989, filed May 28, 1991, which is now abandoned.

FIELD OF THE INVENTION

The present, invention relates generally to an apparatus for blending a powder with a liquid, and more specifically to a centrifugal pump which is modified to act, as a blender.

BACKGROUND OF THE INVENTION

Blending powders with liquids is a fairly common operation in the food processing industry. The powder may simply be added to a holding tank containing the liquid, and if desired the blend may be agitated, but this method leaves unsolved the problem of undissolved powder for difficult to dissolve ingredients.

U.S. Pat. No. 3,606,270 teaches a centrifugal pump which is modified to serve as a continuous powder blender. The impeller of the pump has a recessed eye portion of substantial depth in the top thereof, and the liquid and particulate material which are to be blended are both delivered together into the eye of the impeller. However; in an industrial application the blender taught in this patent was determined not to be as efficient as the blender disclosed herein because the pumping action of the mixer is significantly reduced and therefore its ability to discharge highly viscous slurries is impaired. Therefore this prior art apparatus needs an additional discharge pump and screen for higher viscosity or solid containing slurries.

The above mentioned shortcomings of the continuous powder mixer taught in U.S. Pat. No. 3,606,270 are recognized in U.S. Pat. No. 4,850,704. The solution taught in this later patent a two stage blender wherein the first stage is like the blender taught in U.S. Pat. No. 3,606,270 and the second stage receives the mixture discharged from the first stage and then discharges the mixture at a relatively high discharge pressure, It is thus apparent that the need exists for an improved apparatus suitable for use in the food processing industry for blending a powder and a liquid.

There is provided in accordance with the present invention an apparatus which has the capacity to satisfactorily blend a liquid with a powder and pump the resultant viscous slurry in a single stage operation.

BRIEF DESCRIPTION OF THE DRAWINGS

The features of the present invention which are believed to be novel are set forth with particularity in the appended claims. The present invention, both as to its structure and manner of operation, may best be understood by referring to the following detailed description, taken in accordance with the accompanying drawings in which:

DETAILED DESCRIPTION OF THE INVENTION

Figure 1:
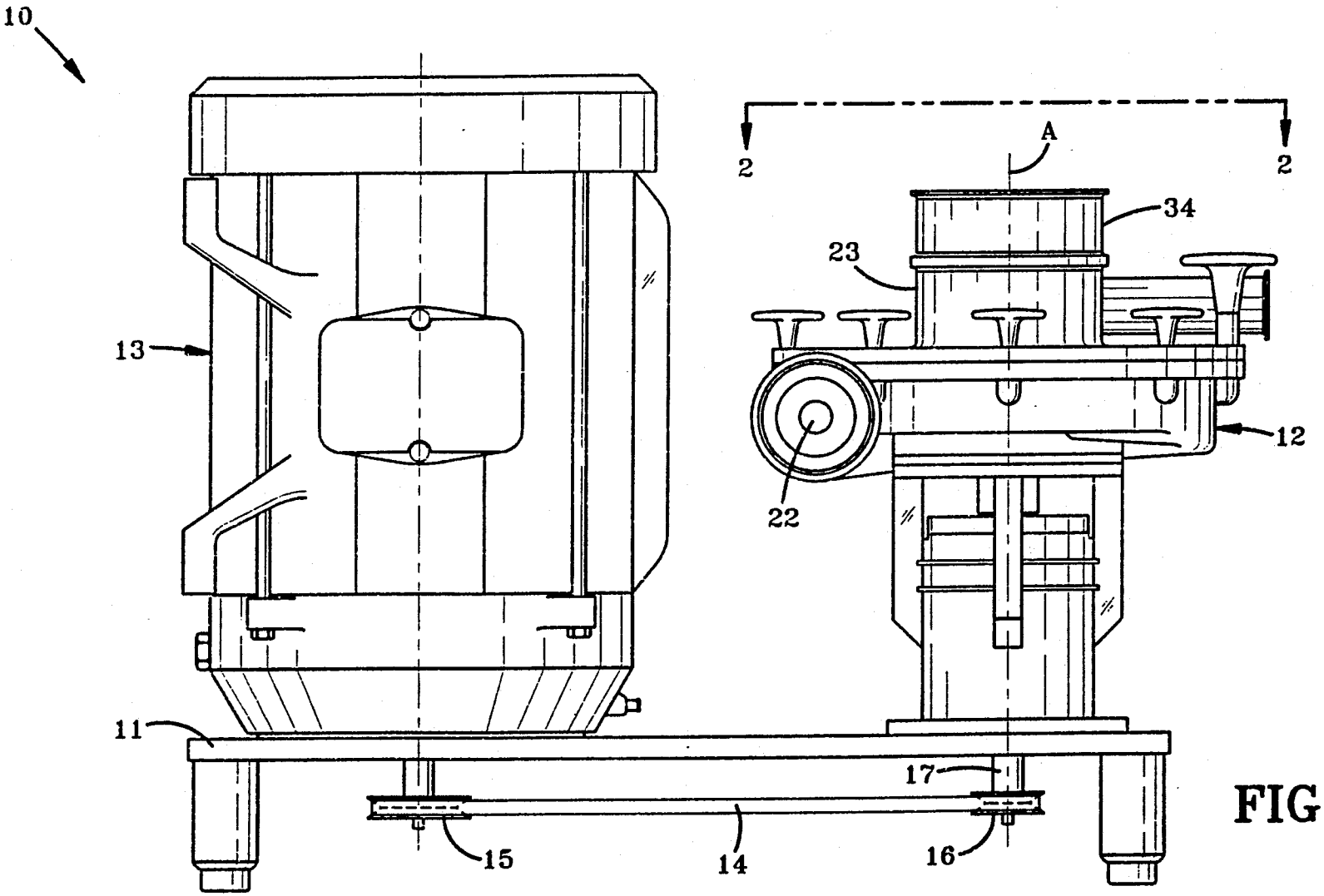
FIG. 1 is a side elevation view of an apparatus according to the invention.

Referring first to FIG. 1 there is shown a side elevation view of an apparatus 10 in accordance with a preferred embodiment of the invention. A base 11 supports the apparatus 12 for blending a liquid with a powder and an electric motor 13 acts in conjunction with a suitable power transmission means, such as a belt 14 and pulleys 15, 16 as a means for rotating the drive shaft 17 of the blending apparatus. In a working example a fifty horsepower electric motor 13 was used for supplying power to the blender, but it is understood that the horsepower of the power source may be in the range of about twenty-five to fifty horsepower depending upon the desired speed of blending and the viscosity of the slurry being blended and pumped. Preferably the belt 14 is a cogged belt which has less slippage, but a multiple V-belt system may be employed if noise reduction is desired. Alternatively, the power source could be aligned with the drive shaft of the blender and mechanically coupled thereto.

Figure 2:
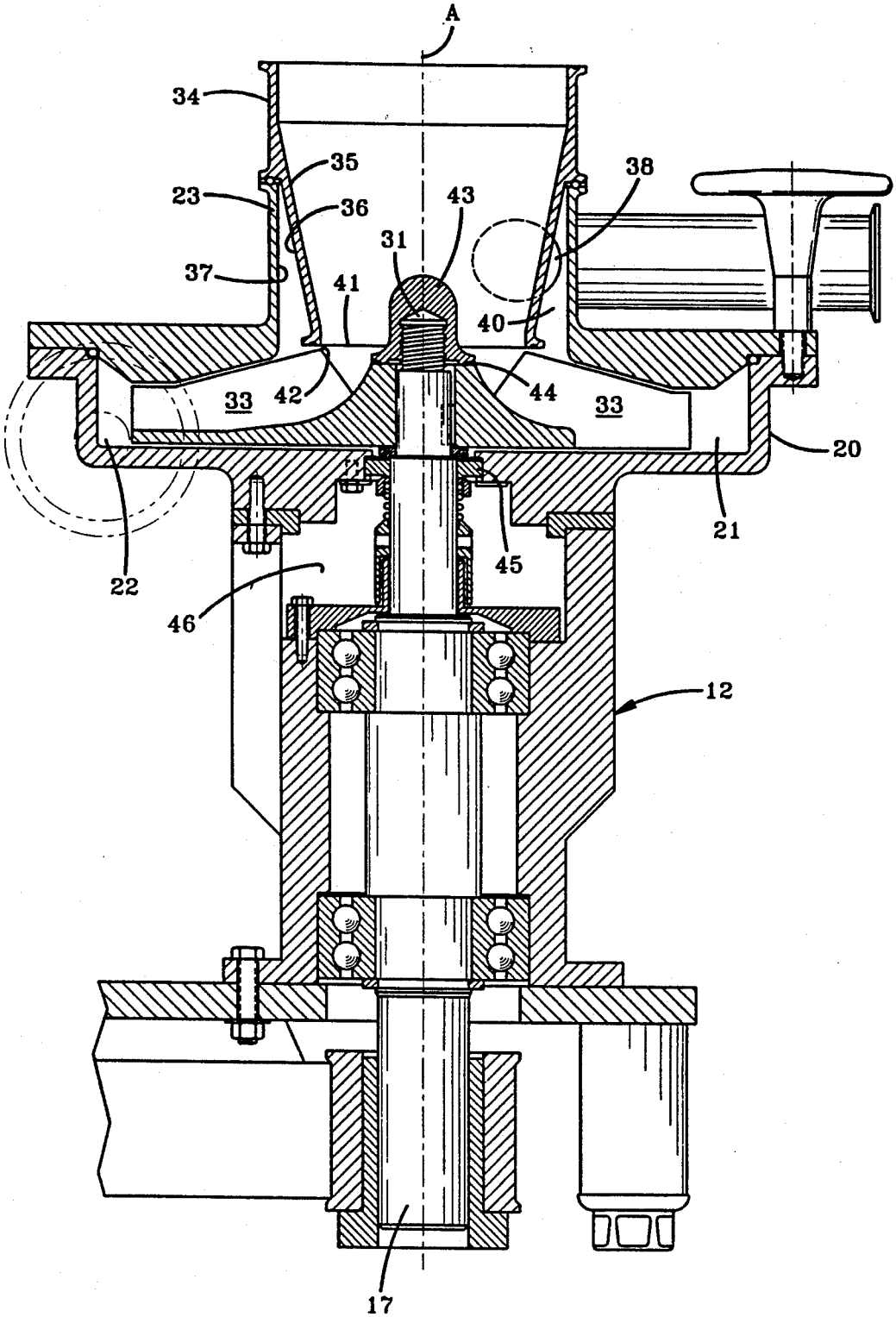
FIG. 2 is a fragmentary cross-sectional side elevation view of the apparatus taken in a vertical plane along line 2—2 of FIG. 1.

Referring next to FIG. 2 in conjunction with FIG. 1 the structure of the apparatus may be described in detail. A casing 20 encloses a mixing chamber 21. The mixing chamber communicates with a slurry discharge port 22 which extends through the casing. The casing has an inlet member 23 which extends from an upper portion of the casing, with a bore extending through the inlet member and communicating with the mixing chamber. The bore has a vertically extending longitudinal axis A, and preferably the bore is cylindrical. As used herein and in the claims, terms such as "upper", "lower", "above", "below" "up" and "down" are understood to be taken in the context of an apparatus according to the invention oriented with a vertically extending drive shaft with the impeller disposed at or near the upper end of the drive shaft.

A vertically extending drive shaft 17 extends through a passageway in a lower portion of the casing. Preferably, the drive shaft extends vertically a distance such that a portion 31 of the drive shaft is disposed within the bore of the inlet member of the casing. The drive shaft has an axis of rotation A which is coincidental with the longitudinal axis of the bore through the inlet member of the casing. As used herein and in the claims terms such as "radially"Z, "radially inwardly", "radially outwardly" and so forth are understood to refer to lines which are perpendicular to and intersect the axis of rotation of the drive shaft.

A bladed impeller 33 is mounted upon the drive shaft and is secured thereto by suitable means for securing such as a nut 43 and a sanitary washer 44. The impeller is disposed within both the mixing chamber and the bore through the inlet member 23 of the casing 20. In a preferred embodiment the impeller has seven blades which extend radially outwardly from the drive shaft in the usual manner.

Figure 3:
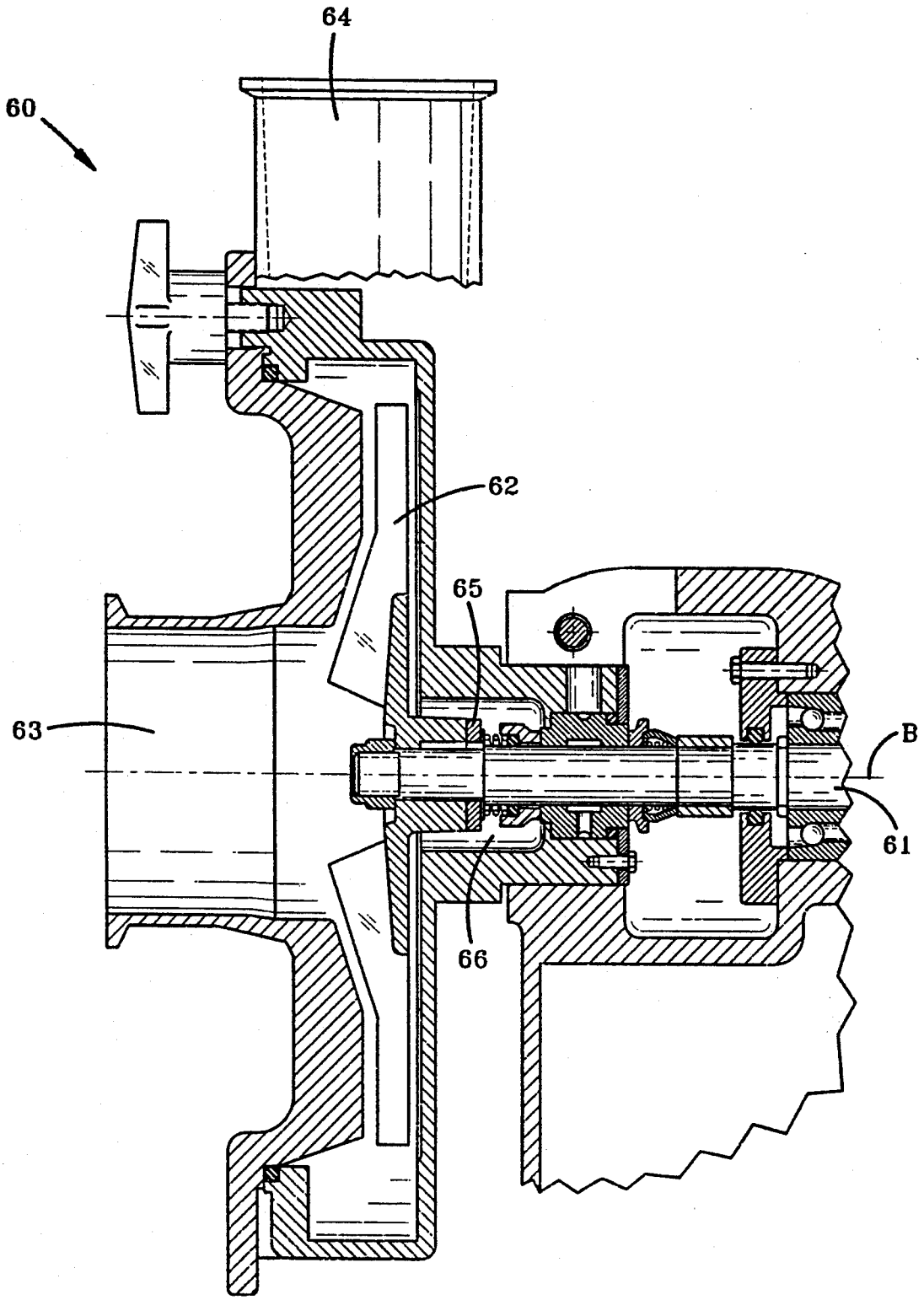
FIG-3 PRIOR ART
FIG. 3 is a fragmentary sectional side elevation view of a prior art centrifugal pump which has not been modified to function as a blender for liquids and powders.

Referring next to FIG. 3, there is shown a fragmentary view of a prior art pump 60 which was modified to manufacture a working model of the present invention. Such a prior art pump is available from Fristam Pump, Inc., 2410 Parview Road, Middleton, Wis. 53562 as a Model 1150 pump. The intended use of such prior art pump is for pumping liquids, and the intended operative orientation of such a prior art pump is with the axis of rotation B of its drive 15 shaft 61 extending horizontally. A bladed impeller 62 which is mounted on the drive shaft rotates in a vertical plane, and the bore 63 through the inlet member of the casing extends horizontally. The outlet port 64 is oriented vertically. The liquid which is being pumped may freely pass into a space 66 which is located on the side of the impeller which is distal from the bore 63 through the inlet member, with a sealing member 65 disposed within the space 66. Such a structure is acceptable in a pump with a horizontal drive shaft because the liquid in the space 66 may act as a cooling and lubricating agent.

Referring again to FIGS. 1 and 2, in an apparatus according to the present invention, having a vertically extending drive shaft 17, it is preferable to have a sealing member 45 disposed in a sealing relationship with the drive shaft to prevent liquid from entering the space 46 which is disposed below the mixing chamber 21. Powder may settle in the space 46 resulting in cleaning problems and possibly causing other problems.

A powder inlet tube 34 extends into the bore through the inlet member of the casing. The vertically lower portion 35 of the powder inlet tube has a hollow truncated conical configuration with an exterior surface 36 of the powder inlet tube spaced apart from an interior surface 37 of the bore of the inlet member of the casing. The inlet member of the casing has a liquid inlet port 38 therethrough disposed such that a liquid may pass through the inlet port and enter the mixing chamber via the space 40 between the exterior surface 36 of the powder inlet tube and the interior surface 37 of the inlet member of the casing.

As used herein and in the claims "liquid" is understood to refer to both a liquid such as water that does not yet have a powder blended therewith as well as a slurry comprising a liquid blended with a powder. The reason for this terminology is that an apparatus according to the invention may be utilized for blending additional powder with a slurry. The vertically lowest edge 41 of the powder inlet tube is radially aligned with the vertically highest extent 42 of the blades 33 of the impeller such that the minimum vertical distance between the impeller and the powder inlet tube is not greater than about 5/16 inch. In the working model the gap was about 3/16 inch. It is believed to be critical to the practice of the invention that the minimum vertical distance between the impeller and the powder inlet tube is small enough that a powder delivered through the powder inlet tube does not blend With a liquid delivered through the inlet port until both the liquid and powder are disposed vertically below the vertically highest extent of the blades of the impeller. In one trial the gap was too large with the result that the liquid and powder combined to form a very viscous substance that fouled the apparatus in the region of the gap. It is understood that the size of the gap may vary within the preferred range depending upon the materials being blended. It is preferred that the actual blending of the liquid and the powder occurs at or below the junction of the lowest extent of the powder inlet tube 34 and the highest extent of the blades of the impeller 33. It is believed that this close proximity of the powder inlet tube to the impeller allows the apparatus to function simultaneously, in a single stage, as both a blender and a pump because the flow of liquid through the apparatus can remain substantially constant. Blending is then completed as the slurry moves along the impeller prior to exiting the mixing chamber 21, through the slurry discharge port 22.

Figure 4:
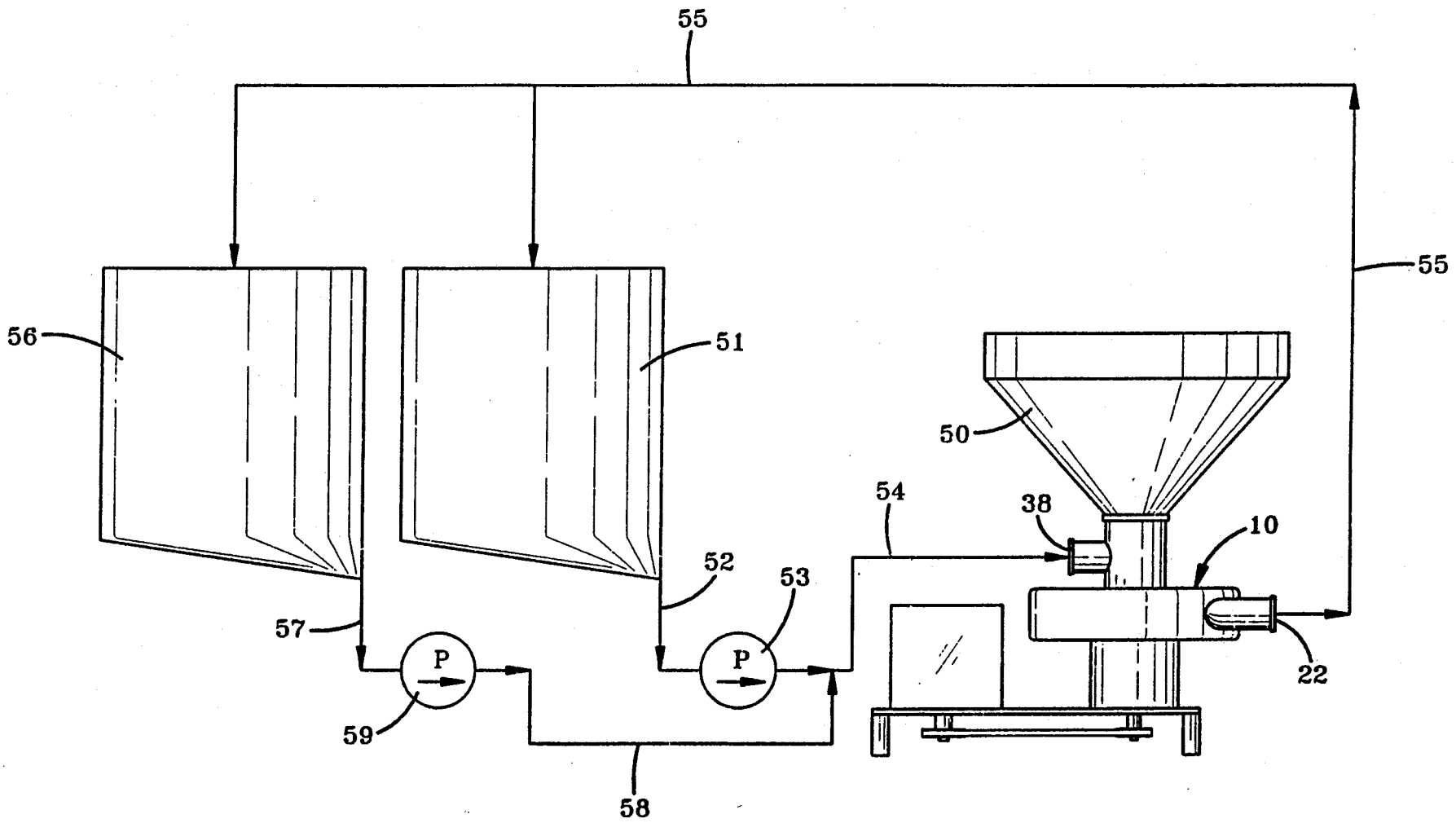
FIG. 4 is a schematic representation of an industrial installation employing an apparatus according to the invention.

The utility of the apparatus disclosed herein may best be understood by referring to FIG. 4 which is a schematic representation of an industrial installation employing an apparatus according to the invention. An apparatus 10 according to the invention has a means for supplying powder 50 mechanically connected to the powder inlet tube of the apparatus. The means for supplying powder 50 may be either a hopper or a bin, and of course could be as elaborate of a system as is desired. A first holding tank 51 may have a predetermined amount of a liquid starting material deposited therein. The liquid from the holding tank may pass through a first conduit means 52, a supply pump 53 and a second conduit means 54 to the liquid inlet port 38 of the apparatus 10. If the proximity of the tank 52 to the apparatus 10 is small enough, supply pump 53 may be eliminated because the apparatus 10 functions both as a mixer and a pump. A third conduit means 55 extends between the slurry discharge port 22 of the apparatus 10 and the first holding tank 51.

If desired, the system may further comprise a second holding tank 58 and associated conduit means 57, 58 and a supply pump 59 which are in communication with the conduit means 54 which extends to the liquid inlet port 38 of the apparatus 10. The third conduit means 55 also extends to the second holding tank 56 in such a configuration. It is understood that any desired number of holding tanks may be employed in such a system.

If desired, a liquid, for example water, may pass through the system to be blended with a first powder to form a slurry which is collected in a holding tank, and then the slurry may pass through the system to have more of the same powder, or a second powder, added thereto and then be collected once again in a holding tank.

Of course, an apparatus according to the invention could simply be used in-line with no holding tanks involved.

An apparatus according to the invention has industrial applications in the food industry, pharmaceutical industry, chemical industry, or any other industry where the thorough mixing of powders with liquids is required.

While certain representative embodiments and details have been described for the purpose of illustrating the invention, it will be apparent to those skilled in the art that various changes and modifications may be made therein without departing from the spirit or scope of the invention.

I claim:

1. An apparatus for blending a powder with a liquid comprising:

(a) a casing enclosing a mixing chamber, the mixing chamber communicating with a slurry discharge port extending through the casing, the casing having an inlet member extending from an upper portion of the casing with a bore extending through the inlet member and communicating with the mixing chamber, said bore having a vertically extending longitudinal axis;

(b) a vertically extending drive shaft which extends through a passageway in a lower portion of the casing, the axis of rotation of the drive shaft being coincidental with the longitudinal axis of said bore;

(c) a bladed impeller mounted upon the drive shaft such that the impeller is disposed within both the mixing chamber and the bore of the inlet member, the drive shaft having only one impeller mounted thereon;

(d) a powder inlet tube which extends into the bore of the inlet member with an exterior surface of the powder inlet tube spaced apart from an interior surface of the inlet member, the inlet member having an inlet port therethrough disposed such that a liquid may pass through the inlet port and enter the mixing chamber via a space between the exterior surface of the powder inlet tube and the interior surface of the inlet member, a vertically lowest edge of the powder inlet tube being radially aligned with the vertically highest extent of the blades of the impeller and spaced above the impeller to define a minimum vertical distance between the impeller and the powder inlet tube that is not greater than about 5/16 inch.

2. An apparatus for blending a powder with a liquid according to claim 1 wherein the bore extending through the inlet member is cylindrical.

3. An apparatus for blending a powder with a liquid according to claim 1 further comprising means for rotating the drive shaft.

4. An apparatus for blending a powder with a liquid according to claim 2 further comprising means for rotating the drive shaft.

5. An apparatus for blending a powder with a liquid according to claim 1 wherein the drive shaft has a sealing member associated therewith, to prevent liquid from exiting the mixing chamber in the region of the drive shaft.

6. An apparatus for blending a powder with a liquid according to claim 2 wherein the drive shaft has a sealing member associated therewith, to prevent liquid from exiting the mixing chamber in the region of the drive shaft.

7. An apparatus for blending a powder with a liquid according to claim 3 wherein the drive shaft has a sealing member associated therewith, to prevent liquid from exiting the mixing chamber in the region of the drive shaft.

8. An apparatus for blending a powder with a liquid according to claim 4 wherein the drive shaft has a sealing member associated therewith, to prevent liquid from exiting the mixing chamber in the region of the drive shaft.

* * * * *

UNITED STATES PATENT AND TRADEMARK OFFICE

CERTIFICATE OF CORRECTION

PATENT NO. : 5,322,357

DATED : June 21, 1994

INVENTOR(S) : Terrence B. Mazer

It is certified that error appears in the above-identified patent and that said Letters Patent is hereby corrected as shown below:

Column 1, line 39, "patent a" should be --patent is a--.

Column 2, line 50, ""radially "Z," should be --"radially",--.

Column 3, line 50, "With" should be --with--.

Signed and Sealed this

Thirteenth Day of September, 1994

*Attest:*

*Attesting Officer*

BRUCE LEHMAN

*Commissioner of Patents and Trademarks*